US010018191B2

(12) United States Patent
Yokota et al.

(10) Patent No.: US 10,018,191 B2
(45) Date of Patent: Jul. 10, 2018

(54) CYLINDER APPARATUS

(71) Applicant: KOSMEK LTD, Hyogo (JP)

(72) Inventors: Hideaki Yokota, Hyogo (JP); Keitaro Yonezawa, Hyogo (JP)

(73) Assignee: KOSMEK LTD., Hyogo (JP)

( * ) Notice: Subject to any disclaimer, the term of this patent is extended or adjusted under 35 U.S.C. 154(b) by 488 days.

(21) Appl. No.: 14/649,955

(22) PCT Filed: Dec. 25, 2013

(86) PCT No.: PCT/JP2013/084734
§ 371 (c)(1),
(2) Date: Jun. 5, 2015

(87) PCT Pub. No.: WO2014/104123
PCT Pub. Date: Jul. 3, 2014

(65) Prior Publication Data

US 2015/0308423 A1 Oct. 29, 2015

(30) Foreign Application Priority Data

Dec. 28, 2012 (JP) ..... 2012-289509

(51) Int. Cl.
*F15B 15/28* (2006.01)
*F04B 39/08* (2006.01)
(Continued)

(52) U.S. Cl.
CPC ..... *F04B 39/08* (2013.01); *B25B 5/06* (2013.01); *F04B 37/00* (2013.01);
(Continued)

(58) Field of Classification Search
CPC ..... F15B 15/2807; F15B 15/2892; F15B 15/1423; F15B 15/1433; B23Q 17/22; B25B 5/062; B25B 5/16
(Continued)

(56) References Cited

U.S. PATENT DOCUMENTS 3,661,053 A 5/1972 Rich
6,427,992 B1 * 8/2002 Noda ..... B25B 5/062 269/24
(Continued)

FOREIGN PATENT DOCUMENTS

JP S5016385 U 2/1975
JP S60129410 A 7/1985
(Continued)

OTHER PUBLICATIONS

Chinese Office Action dated Jan. 20, 2017 issued in corresponding Chinese Patent Application No. 201380068239.6 and English translation thereof.
Office Action of U.S. Appl. No. 14/653,898, dated Aug. 25, 2017.
Chinese Office Action dated Mar. 18, 2016 and English translation thereof.

*Primary Examiner* — Thomas E Lazo
*Assistant Examiner* — Dustin T Nguyen
(74) *Attorney, Agent, or Firm* — Bacon & Thomas, PLLC

(57) ABSTRACT

Apparatus configuration in which: a piston (10) is inserted into a housing (1) ascendably and descendably; and pressurized oil supplied to and discharged from a driving chamber (11) arranged above the piston (10). An output rod (15) inserted into an upper wall (2) of the housing (1) protrudes upward from the piston (10). A descent-detecting first detection valve (31) and an ascent-detecting second detection valve (32) arranged outside the periphery of the output rod (15) and in the upper wall (2), circumferentially spaced apart at a predetermined interval. Each first detection valve (31) and second detection valve (32) has an operated portion (49) (79) which faces the piston (10) from above. The apparatus is configured so that pressurized air for detection is supplied through a first supply passage (B1) and a second supply passage (B2) inlets (31*a*) (32*a*) of the first detection valve (31) and the second detection valve (32), respectively.

16 Claims, 5 Drawing Sheets

(51) Int. Cl.

| | |
|---|---|
| ***F15B 15/20*** | (2006.01) |
| ***F04B 37/00*** | (2006.01) |
| ***F04B 39/10*** | (2006.01) |
| ***F04B 39/12*** | (2006.01) |
| ***B25B 5/06*** | (2006.01) |

(52) U.S. Cl.
CPC ..... *F04B 39/1013* (2013.01); *F04B 39/121* (2013.01); *F15B 15/204* (2013.01); *F15B 15/2807* (2013.01)

(58) Field of Classification Search
USPC ..... 92/5 R; 269/20, 24, 25
See application file for complete search history.

(56) References Cited

U.S. PATENT DOCUMENTS

| | | | | |
|---|---|---|---|---|
| 2002/0134230 | A1 | 9/2002 | Hirling | |
| 2014/0138890 | A1* | 5/2014 | Kawakami ..... | F15B 15/2807 269/27 |
| 2015/0345521 | A1 | 12/2015 | Yokota et al. | |

FOREIGN PATENT DOCUMENTS

| | | | |
|---|---|---|---|
| JP | H09257005 | A | 9/1997 |
| JP | H11292500 | A | 10/1999 |
| JP | 2004068875 | A | 3/2004 |
| WO | 2013051333 | A1 | 4/2013 |

* cited by examiner

CYLINDER APPARATUS

TECHNICAL FIELD

The present invention relates to a cylinder apparatus provided with a function of detecting a position to which a piston has been moved, and more particularly relates to a cylinder apparatus which is suitably applied to a work clamp.

BACKGROUND ART

As such a cylinder apparatus having the function of detection, conventionally, there is an apparatus described in Patent Literature 1 (Japanese Unexamined Patent Publication No. 129410/1985 (Tokukaishou 60-129410)).

FIG. 5 of the above known document illustrates a structure in which: a piston is inserted horizontally movably into a housing; a detection valve configured to check the position to which the piston has been moved with respect to a horizontal direction is arranged in each of right and left end walls of the housing; and a detection rod of each detection valve is operated by the piston.

CITATION LIST

Patent Literature

Patent Literature 1: Japanese Unexamined Patent Publication No. 129410/1985 (Tokukaishou 60-129410)

SUMMARY OF INVENTION

Technical Problem

In the above-described known art, the detection valve is arranged in each of the right and left end walls of the housing. Therefore, if the left end wall is attached to a stationary stand such as a table, it is difficult to access the left detection valve, and it is laborious to perform maintenance on the left detection valve.

An object of the present invention is to provide a cylinder apparatus in which maintenance on detection valves is easy.

Solution to Problem

In order to achieve the above object, a cylinder apparatus is structured as follows, for example, as shown in FIG. 1A to FIG. 5B, in an aspect of the present invention.

The apparatus has a configuration in which: a piston 10 is inserted into a housing 1 ascendably and descendably; and pressurized fluid for driving is able to be supplied to and discharged from a driving chamber 11 arranged above the piston 10. An output rod 15 inserted into an upper wall 2 of the housing 1 is connected to the piston 10. A descent-detecting first detection valve 31 and an ascent-detecting second detection valve 32 are arranged outside a periphery of the output rod 15 and in the upper wall 2, to be circumferentially spaced apart from each other at a predetermined interval. Each of the first detection valve 31 and the second detection valve 32 has an operated portion 49, 79 which faces the piston 10 from above. The apparatus is configured so that pressurized air for detection is able to be supplied, through a first supply passage B1 and a second supply passage B2, to respective inlets 31*a* and 32*a* of the first detection valve 31 and the second detection valve 32, respectively.

The above aspect of the present invention provides following functions and effects.

Since the two detection valves which are the descent-detecting first detection valve and the ascent-detecting second detection valve are arranged outside the periphery of the output rod inserted into the upper wall of the housing, and in the upper wall, it is possible to access the two detection valves from above even in the case where a lower wall of the housing is attached to a stationary stand such as a table, or in the case where a lower half portion of the housing is inserted into a mounting hole of such a stationary stand, for example. Therefore, maintenance on the detection valves is not laborious.

Moreover, to install the two detection valves in the upper wall, an unused space in the upper wall can be used as an installation space for the valves, and this enables the cylinder apparatus to be kept compact in size.

Accordingly, there is provided the cylinder apparatus which is compact in size and in which maintenance on the detection valves is easy.

In the present invention, it is preferable that an axis of each of the first detection valve 31 and the second detection valve 32 is inclined to become closer to an axis of the piston 10 downwardly, and an angle of inclination is set to fall within a range from 5 degrees to 15 degrees.

According to this aspect, it is possible to prevent the two detection valves from interfering with a sealing member, a scraper, and/or the like installed outside the periphery of the output rod and in the upper wall, while reducing the radial size of the housing, and this enables the cylinder apparatus to be compact in size.

Further, in the present invention, it is preferable that: the upper wall 2 is formed into a substantially rectangular or square shape in plan view, and a supply and discharge passage 21 which is communicatively connected to the driving chamber 11 is formed in one wall portion out of four wall portions respectively corresponding to four peripheral sides of the upper wall 2; and the first detection valve 31 and the second detection valve 32 are provided in any other wall portion than the wall portion where the supply and discharge passage 21 is formed out of the four wall portions.

The above structure enables the cylinder apparatus to be more compact in size.

Further, in the present invention, it is preferable that, the upper wall 2 has a flange 7 for mounting, and a supply and discharge port P1 communicatively connected to the supply and discharge passage 21 is opened onto a mounting surface 7*a* formed on an under surface of an outer periphery portion of the flange 7.

In each of the above-described aspects, it is preferable to structure the apparatus as follows.

Specifically, the descent-detecting first detection valve 31 is configured to be opened by the piston 10 in the course of movement of the piston 10 from a lower limit position to an upper limit position, and to be closed when the piston 10 descends a predetermined first stroke S1 from the upper limit position; and the ascent-detecting second detection valve 32 is configured to be closed by the piston 10 when the piston 10 moves from the lower limit position to the upper limit position or to a position in the vicinity of the upper limit position, and to be opened when the piston 10 descends a predetermined second stroke S2 from the upper limit position, and a length of the second stroke S2 is set to be smaller than a length of the first stroke S1.

The above structure ensures that a descent position and an ascent position are detected separately from each other.

Further, it is preferable to structure the first detection valve 31 in the present invention as follows, for example, as shown in FIG. 4A and FIG. 4B.

Specifically, the descent-detecting first detection valve 31 includes: a first installation hole M1 formed in the upper wall 2 so as to face the driving chamber 11 from above; a first casing C1 mounted in the first installation hole M1; a first detection rod 41 inserted into the first casing C1, the first detection rod 41 having a lower pressure receiving portion 45, an upper pressure receiving portion 47 of which pressure receiving area is larger than that of the lower pressure receiving portion 45, and the operated portion 49; a pressure chamber 51 formed above the upper pressure receiving portion 47; a through hole 52 formed through the first detection rod 41 so as to communicatively connect the pressure chamber 51 to the driving chamber 11; a poppet type valve surface 55 formed on a lower portion of the upper pressure receiving portion 47; and a valve seat 54 formed on the first casing C1, the valve seat 54 configured to be closed by the valve surface 55 when the first detection rod 41 descends.

The above structure ensures that the descent-detecting first detection valve is closed with a mechanically simple structure.

Further, it is preferable to structure the second detection valve 32 in the present invention as follows, for example, as shown in FIG. 5A and FIG. 5B.

Specifically, the ascent-detecting second detection valve 32 includes: a second installation hole M2 formed in the upper wall 2 so as to face the driving chamber 11 from above; a second casing C2 mounted in the second installation hole M2; a second detection rod 42 inserted into the second casing C2, the second detection rod 42 having a lower pressure receiving portion 75, an upper pressure receiving portion 77 of which pressure receiving area is larger than that of the lower pressure receiving portion 75, and the operated portion 79; a pressure chamber 81 formed above the upper pressure receiving portion 77; a through hole 82 formed through the second detection rod 42 so as to communicatively connect the pressure chamber 81 to the driving chamber 11; a spool type valve surface 85 formed on an outer peripheral surface of the second detection rod 42; and a valve hole 84 formed in the second casing C2, the valve hole 84 configured to be closed by the valve surface 85 when the second detection rod 42 ascends.

The above structure ensures that the ascent-detecting second detection valve is closed with a mechanically simple structure.

BRIEF DESCRIPTION OF DRAWINGS

FIG. 1A is an elevational view of the clamp in an unclamping state, corresponding to a section taken along a line 1A-1A of FIG. 2A.

REFERENCE SIGNS LIST

Figure 1B:
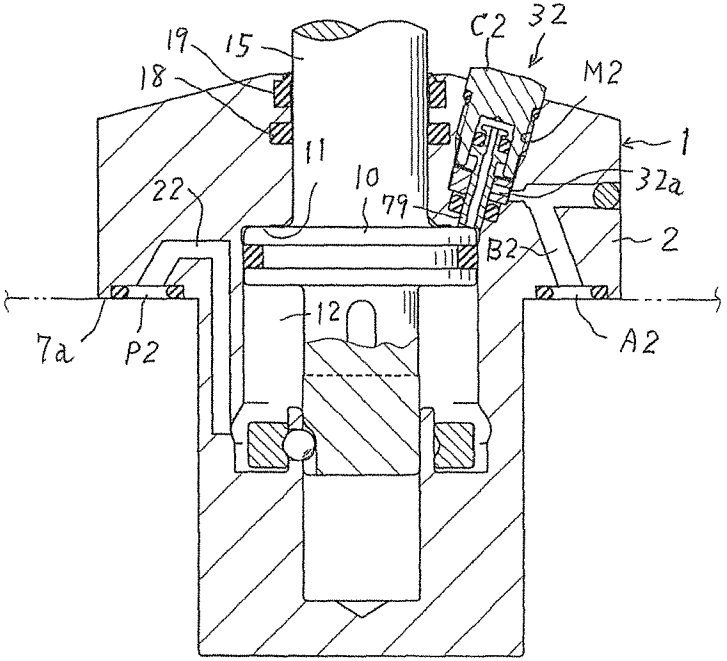
FIG. 1B is a view corresponding to a section taken along a line 1B-1B of FIG. 2A, and similar to FIG. 1A.

1: housing, 2: upper wall, 7: flange, 7*a:* mounting surface, 10: piston, 11: driving chamber (first driving chamber), 15: output rod, 21: supply and discharge passage (first supply and discharge passage), 31: first detection valve, 31*a:* inlet, 32: second detection valve, 32*a:* inlet, 41: first detection rod, 42: second detection rod, 45: lower pressure receiving portion, 47: upper pressure receiving portion, 49: operated portion, 51: pressure chamber, 52: through hole, 54: valve seat, 55: valve surface, 75: lower pressure receiving portion, 77: upper pressure receiving portion, 79: operated portion, 81: pressure chamber, 82: through hole, 84: valve hole, 85: valve surface, B1: first supply passage, B2: second supply passage, C1: first casing, C2: second casing, M1: first installation hole, M2: second installation hole, P1: supply and discharge port (first supply and discharge port), S1: first stroke, S2: second stroke

DESCRIPTION OF EMBODIMENTS

The following will describe one embodiment of the present invention with reference to FIG. 1A to FIG. 5B.

This embodiment deals with a case, as an example, where a cylinder apparatus is applied to a rotary clamp for clamping a workpiece. First, with reference to FIG. 1A to FIG. 2B, the overall structure of the rotary clamp will be described.

A housing 1 is mounted onto a table T functioning as a stationary stand. The housing 1 includes: an upper wall 2 functioning as one end wall; a lower wall 3 functioning as the other end wall; a cylindrical wall 4 extending vertically; and a cylinder hole 5 formed inside the cylindrical wall 4. The upper wall 2 has, on its outer periphery portion, a flange 7 for mounting, and the upper wall 2 is formed into a substantially rectangular shape in plan view. Bolt holes 8 are vertically bored through four corners of the flange 7, respectively. Via fastening bolts (not illustrated) respectively inserted into the bolt holes 8, a mounting surface 7*a* formed on an under surface of the flange 7 is fixed to a top surface of the table T.

Into the cylinder hole 5, a piston 10 is hermetically inserted ascendably and descendably. Above and below the piston 10, a first driving chamber 11 for clamping and a second driving chamber 12 for unclamping are arranged, respectively.

Further, a first supply and discharge passage 21 communicatively connected to the first driving chamber 11 and a second supply and discharge passage 22 communicatively connected to the second driving chamber 12 are formed in a left wall portion, in plan view, out of four wall portions of the upper wall 2 respectively corresponding to four peripheral sides of the upper wall 2.

Furthermore, in the above-described left wall portion of the upper wall 2, a first supply and discharge port P1 communicatively connected to the first supply and discharge passage 21 and a second supply and discharge port P2 communicatively connected to the second supply and discharge passage 22 are opened onto the mounting surface 7*a* of the flange 7. Pressurized oil (pressurized fluid for driving)

is supplied to and discharged from the first driving chamber 11 and the second driving chamber 12 through the first supply and discharge port P1 and the second supply and discharge port P2, respectively, and through the first supply and discharge passage 21 and the second supply and discharge passage 22, respectively.

An output rod 15 is hermetically inserted vertically movably into a through hole 14 provided in a central portion of the upper wall 2. In this embodiment, the output rod 15 is formed integrally with the piston 10. To an upper portion of the output rod 15, a clamp arm 16 is fixed with a nut 17. A sealing member 18 and a scraper 19 are installed outside the periphery of the output rod 15 and in the upper wall 2.

Further, from the piston 10, a lower rod 24 protrudes integrally with the piston 10, and the lower rod 24 is movably inserted into a support hole 25 of the lower wall 3. On an outer peripheral surface of the lower rod 24, three guiding grooves 26 are formed to be circumferentially spaced apart from one another at predetermined intervals. Each guiding groove 26 has a known structure, and includes a straight advance groove 26*a* and a spiral rotational groove 26*b* which are formed with vertical continuity. In an upper portion of a peripheral wall of the support hole 25, three lateral holes 27 are formed to be circumferentially spaced apart from one another at predetermined intervals, and a ball 28 inserted into each lateral hole 27 is fitted in the corresponding guiding groove 26. A ring 29 is rotatably fitted onto outer portions of the balls 28.

In a right wall portion, in plan view, out of the four wall portions of the upper wall 2, a descent-detecting first detection valve 31 and an ascent-detecting second detection valve 32 are provided outside the periphery of the output rod 15 to be circumferentially spaced apart from each other at a predetermined interval. The axis of each of the first detection valve 31 and the second detection valve 32 is inclined so as to become closer to the axis of the piston 10 downwardly. On this account, it is possible to prevent the two detection valves 31 and 32 from interfering with the sealing member 18 and/or the scraper 19 installed outside the periphery of the output rod 15 and in the upper wall 2 while reducing the radial size of the housing 1, and this enables the cylinder apparatus to be compact in size. It should be noted that the angle of the above inclination is preferably set to fall within the range from 5 degrees to 15 degrees.

Further, in the right wall portion, a first supply port A1 and a second supply port A2 are opened onto the mounting surface 7*a* formed on the under surface of the flange 7 so that pressurized air for detection is supplied through these ports. The first supply port A1 and the second supply port A2 are communicatively connected to respective inlets 31*a* and 32*a* of the first detection valve 31 and the second detection valve 32, respectively, via the first supply passage B1 and the second supply passage B2, respectively.

The following will describe, in detail, the first detection valve 31 and the second detection valve 32.

First, the descent-detecting first detection valve 31 will be described, mainly with reference to FIG. 4A and FIG. 4B. FIG. 4A is a partial enlarged view of FIG. 1A. FIG. 4B is a partial enlarged view of FIG. 3A.

The first detection valve 31 is opened by the piston 10 in the course of movement of the piston 10 from a lower limit position in FIG. 4B to an upper limit position in FIG. 4A (FIG. 4A illustrates the first detection valve 31 which has already been fully opened). Meanwhile, the first detection valve 31 is closed when the piston 10 descends a predetermined first stroke S1 from the upper limit position in FIG. 4A (FIG. 4B illustrates the first detection valve 31 which has already been fully closed). To be more specific, the first detection valve 31 is structured as follows, as shown in FIG. 4A and FIG. 4B.

Through the upper wall 2, a stepped first installation hole M1 is bored obliquely downward. The first installation hole M1 includes an internal threaded hole 34, a larger diameter hole 35, a medium diameter hole 36, and a smaller diameter hole 37, which are communicatively connected to one another in this order toward the bottom, and the smaller diameter hole 37 faces the first driving chamber 11 from above.

A first casing C1 mounted in the first installation hole M1 includes: a valve barrel 38 installed in a lower portion of the larger diameter hole 35; and a pressing barrel 39 screwed into the internal threaded hole 34. The pressing barrel 39 presses the valve barrel 38 onto a bottom portion of the larger diameter hole 35.

Into the first casing C1, a first detection rod 41 is inserted. The first detection rod 41 includes: a smaller-diameter lower pressure receiving portion 45 hermetically inserted into the medium diameter hole 36 via a lower sealing member 44; a larger-diameter upper pressure receiving portion 47 hermetically inserted into a barrel hole of the pressing barrel 39 via an upper sealing member 46; and a connecting rod 48 provided between the lower pressure receiving portion 45 and the upper pressure receiving portion 47. The pressure receiving area of the upper pressure receiving portion 47 is set to be larger than the pressure receiving area of the lower pressure receiving portion 45.

On a lower end portion of the lower pressure receiving portion 45, there is provided an operated portion 49 configured to come into contact with the piston 10. A pressure chamber 51 is formed above the upper pressure receiving portion 47. The pressure chamber 51 is communicatively connected to the first driving chamber 11 via a through hole 52 which is formed along the axis of the first detection rod 41.

An annular valve seat 54 is formed around an upper opening of a barrel hole of the valve barrel 38, and a poppet type valve surface 55 is formed on a lower portion of the upper pressure receiving portion 47. As shown in FIG. 4B, the valve surface 55 is configured to come into contact with the valve seat 54 when the first detection rod 41 descends. Further, an annular inlet passage 56 is formed between the barrel hole of the valve barrel 38 and an outer peripheral surface of the connecting rod 48. Furthermore, a lateral hole 57 is bored through a peripheral wall of the valve barrel 38, and an inner end portion of the lateral hole 57 forms an inlet 31*a* of the first detection valve 31. The inlet 31 a is communicatively connected to the first supply port A1 via the first supply passage B1. Reference numeral 58 indicates a ball for plugging.

On a lower end surface of the pressing barrel 39, a plurality of radial grooves 59 are formed to be circumferentially spaced apart from one another at predetermined intervals. Further, an annular passage 60 is formed between a lower portion of an outer peripheral surface of the pressing barrel 39 and an inner peripheral surface of the larger diameter hole 35, and a midway portion of the annular passage 60 forms an outlet 31 b of the first detection valve 31. The outlet 31 b is communicatively connected to the outside air via a check valve 62 provided to a discharge passage 61. The check valve 62 includes: a valve seat 62*a;* and a spring 62*c* which urges a ball 62*b* onto the valve seat 62*a*.

Figure 5B:
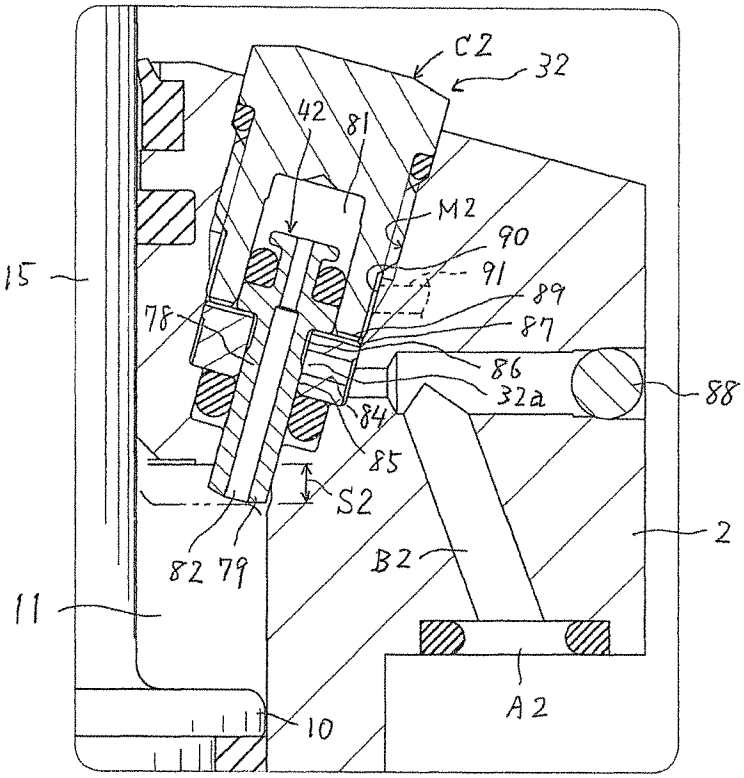
FIG. 5B is a partial enlarged view of FIG. 3B, illustrating the second detection valve in the clamping state.
Figure 5A:
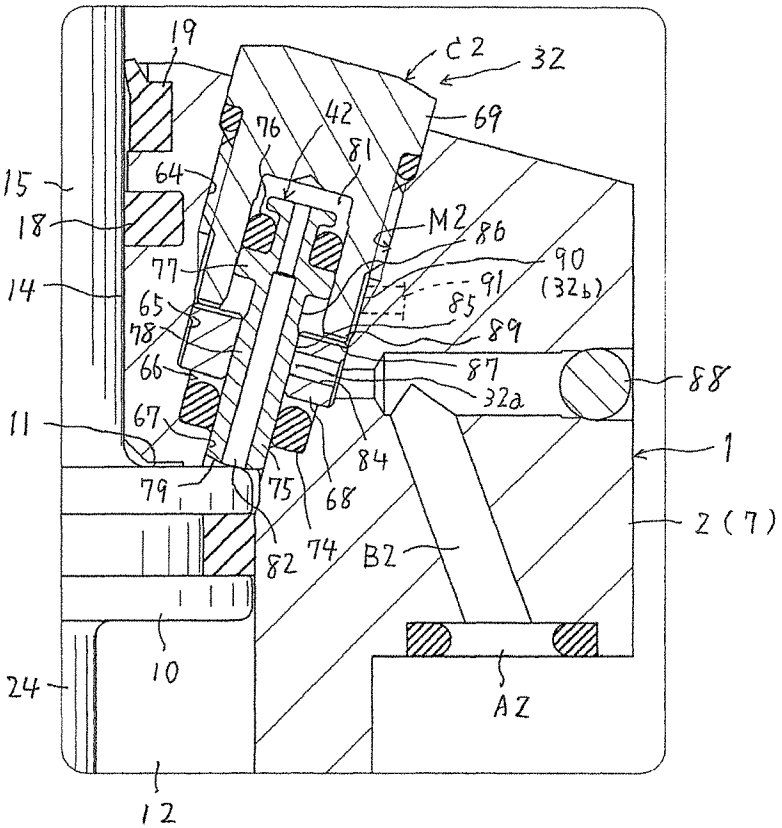
FIG. 5A is a partial enlarged view of FIG. 1B, illustrating an ascent-detecting second detection valve in the unclamping state.

The ascent-detecting second detection valve 32 is closed by the piston 10 when the piston 10 moves from the lower limit position in FIG. 5B to the upper limit position in FIG. 5A or to a position in the vicinity of the upper limit position (FIG. 5A illustrates the second detection valve 32 which has already been fully closed). Meanwhile, the second detection valve 32 is opened when the piston 10 descends a predetermined second stroke S2 from the upper limit position in FIG. 5A (FIG. 5B illustrates the second detection valve 32 which has already been fully opened). The length of the second stroke S2 is set to be smaller than the length of the first stroke S1.

As shown in FIG. 5A and FIG. 5B, the second detection valve 32 is structured as follows, substantially similarly to the first detection valve 31.

Through the upper wall 2, a stepped second installation hole M2 is bored obliquely downward. The second installation hole M2 includes an internal threaded hole 64, a larger diameter hole 65, a medium diameter hole 66, and a smaller diameter hole 67, which are communicatively connected to one another in this order toward the bottom, and the smaller diameter hole 67 faces the first driving chamber 11 from above.

A second casing C2 mounted in the second installation hole M2 includes: a valve barrel 68 installed in a lower portion of the larger diameter hole 65; and a pressing barrel 69 screwed into the internal threaded hole 64. The pressing barrel 69 presses the valve barrel 68 onto a bottom portion of the larger diameter hole 65.

Into the second casing C2, a second detection rod 42 is inserted. The second detection rod 42 includes: a smaller-diameter lower pressure receiving portion 75 hermetically inserted into the medium diameter hole 66 via a lower sealing member 74; a larger-diameter upper pressure receiving portion 77 hermetically inserted into a barrel hole of the pressing barrel 69 via an upper sealing member 76; and a connecting rod 78 provided between the lower pressure receiving portion 75 and the upper pressure receiving portion 77. The pressure receiving area of the upper pressure receiving portion 77 is set to be larger than the pressure receiving area of the lower pressure receiving portion 75.

On a lower end portion of the lower pressure receiving portion 75, there is provided an operated portion 79 configured to come into contact with the piston 10. A pressure chamber 81 is formed above the upper pressure receiving portion 77. The pressure chamber 81 is communicatively connected to the first driving chamber 11 via a through hole 82 which is formed along the axis of the second detection rod 42.

A valve hole 84 is bored through a peripheral wall of the valve barrel 68, and a spool type valve surface 85 and an annular outlet groove 86 are formed, in this order from the bottom, on an outer peripheral surface of the connecting rod 78. As shown in FIG. 5A, the valve surface 85 is configured to close the valve hole 84 when the second detection rod 42 ascends.

An inner end portion of the valve hole 84 forms an inlet 32*a* of the second detection valve 32. The inlet 32*a* is communicatively connected to the second supply port A2 via the second supply passage B2. Reference numeral 88 indicates a ball for plugging.

On an upper end surface of the valve barrel 68, a plurality of radial grooves 87 are formed to be circumferentially spaced apart from one another at predetermined intervals. Further, on a lower end surface of the pressing barrel 69, a plurality of radial grooves 89 are formed to be circumferentially spaced apart from one another at predetermined intervals. An annular passage 90 is formed between a lower portion of an outer peripheral surface of the pressing barrel 69 and an inner peripheral surface of the larger diameter hole 65, and a midway portion of the annular passage 90 forms an outlet 32*b* of the second detection valve 32. The outlet 32*b* is communicatively connected to the outside air via an outlet hole 91, the discharge passage 61, and the check valve 62 (see FIG. 4A).

The rotary clamp having the above-described structure operates as follows.

Figure 1A:
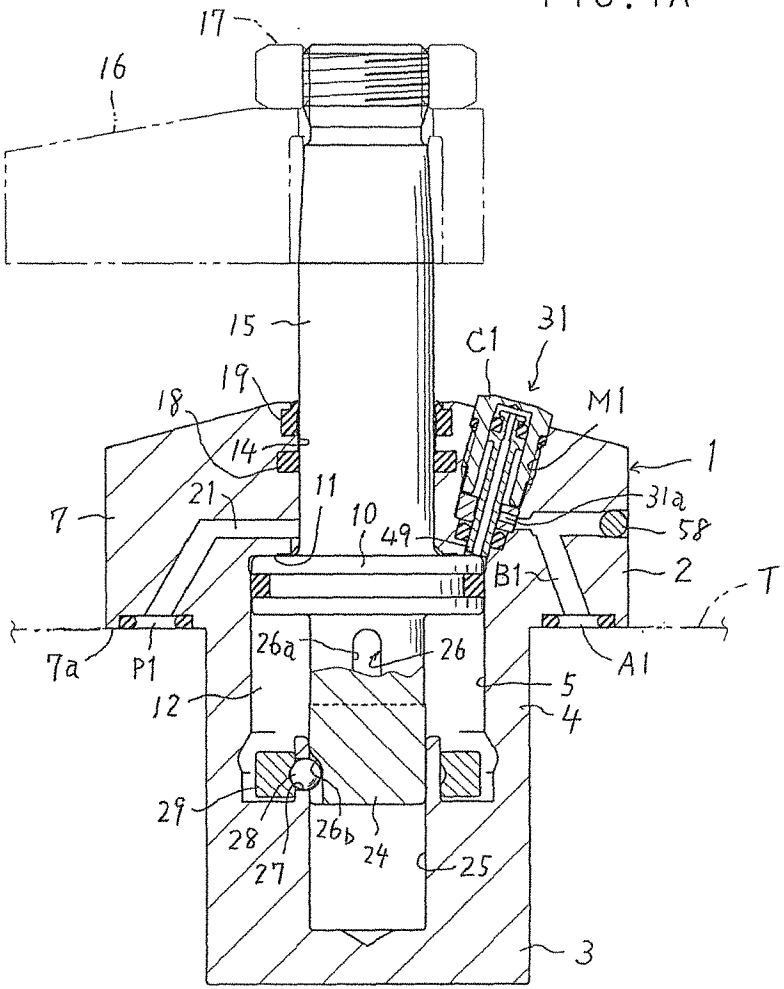
FIG. 1A illustrates a work clamp to which a cylinder apparatus of the present invention is applied.
Figure 2B:
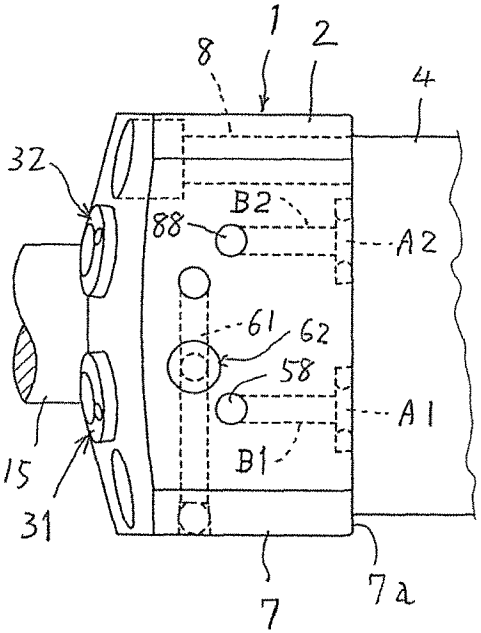
FIG. 2B is a right side view of the clamp of FIG. 2A.
Figure 2A:
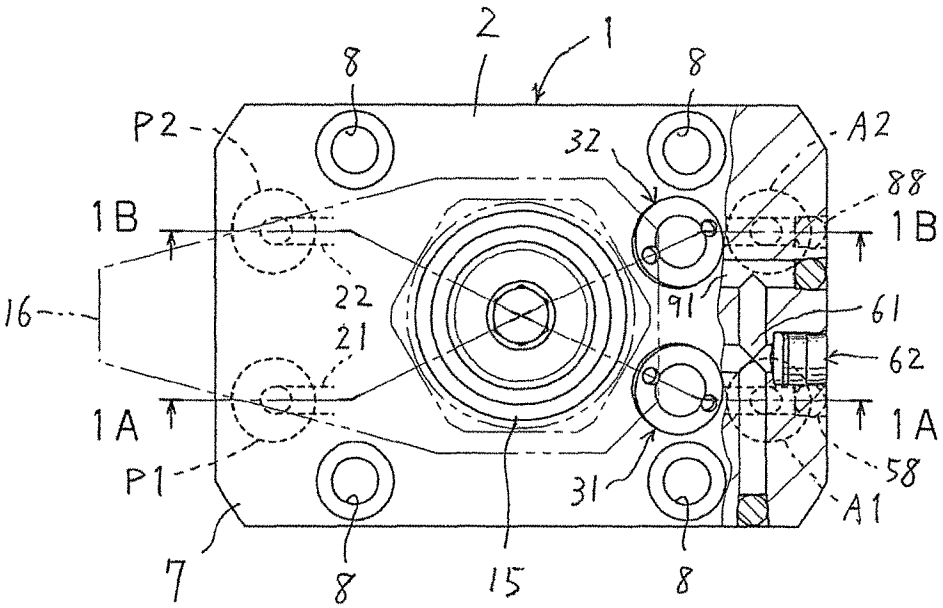
FIG. 2A is a plan view of the clamp of FIG. 1A.

In the unclamping state shown in FIG. 1A and FIG. 1B, pressurized oil in the upper first driving chamber 11 is discharged through the first supply and discharge port P1, while pressurized oil at the second supply and discharge port P2 is supplied to the lower second driving chamber 12. With this, the piston 10 ascends to the upper limit position, and the piston 10 raises the output rod 15 and the clamp arm 16.

In the above unclamping state, the descent-detecting first detection valve 31 shown in FIG. 1A is opened. To be more specific, as shown in FIG. 4A, the piston 10 pushes up the first detection rod 41 via the operated portion 49, and the valve surface 55 of the upper pressure receiving portion 47 is separated from the valve seat 54. On this account, pressurized air supplied to the first supply port A1 flows, through the first supply passage B1, the inlet 31*a*, the annular inlet passage 56, the radial grooves 59, and the outlet 31*b*, to the discharge passage 61, and the pressurized air in the discharge passage 61 pushes the ball 62*b* of the check valve 62 to open the valve 62, thereby to be discharged to the outside air.

Meanwhile, in the above unclamping state, the ascent-detecting second detection valve 32 shown in FIG. 1B is closed. To be more specific, as shown in FIG. 5A, the piston 10 pushes up the second detection rod 42 via the operated portion 79, and the valve surface 85 of the connecting rod 78 closes the valve hole 84. Therefore, the pressure at the second supply port A2 increases to a setting value, and this increase in pressure is detected by a sensor, which shows that the clamp is in the unclamping state.

Figure 3B:
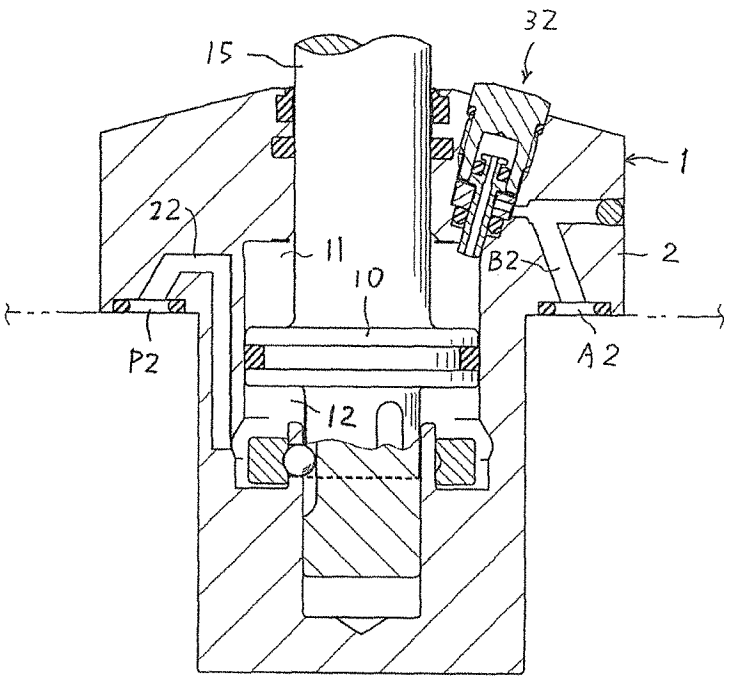
FIG. 3B also illustrates the clamp in the clamping state, and is a view similar to FIG. 1B.
Figure 3A:
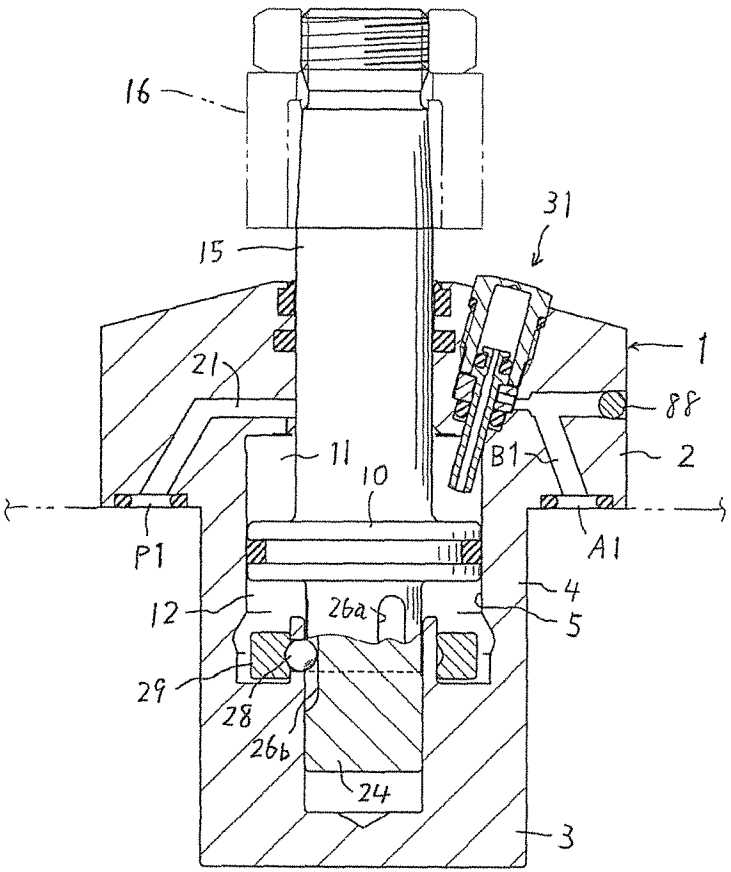
FIG. 3A illustrates the clamp in a clamping state, and is a view similar to FIG. 1A.
Figure 4B:
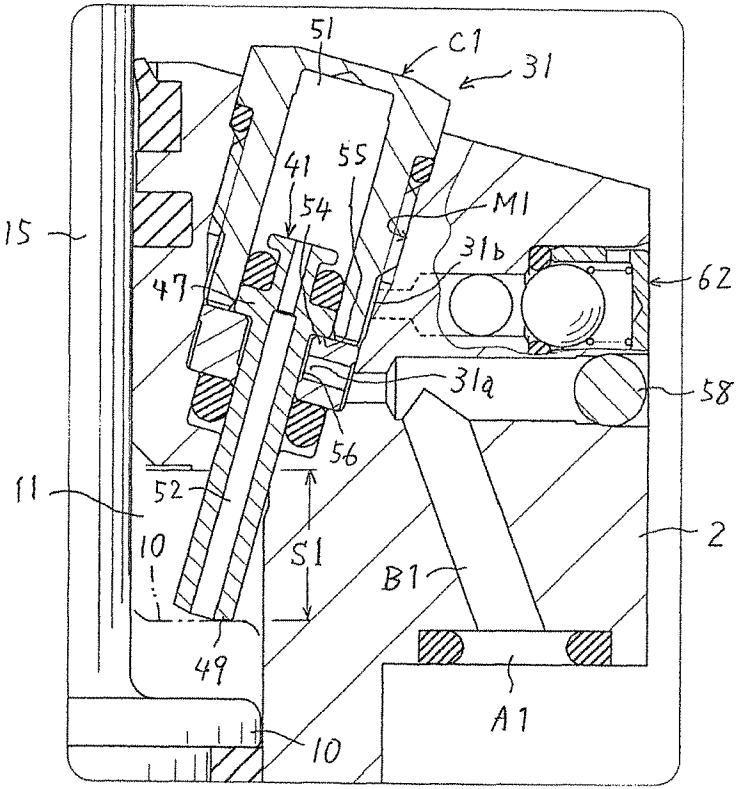
FIG. 4B is a partial enlarged view of FIG. 3A, illustrating the first detection valve in the clamping state.
Figure 4A:
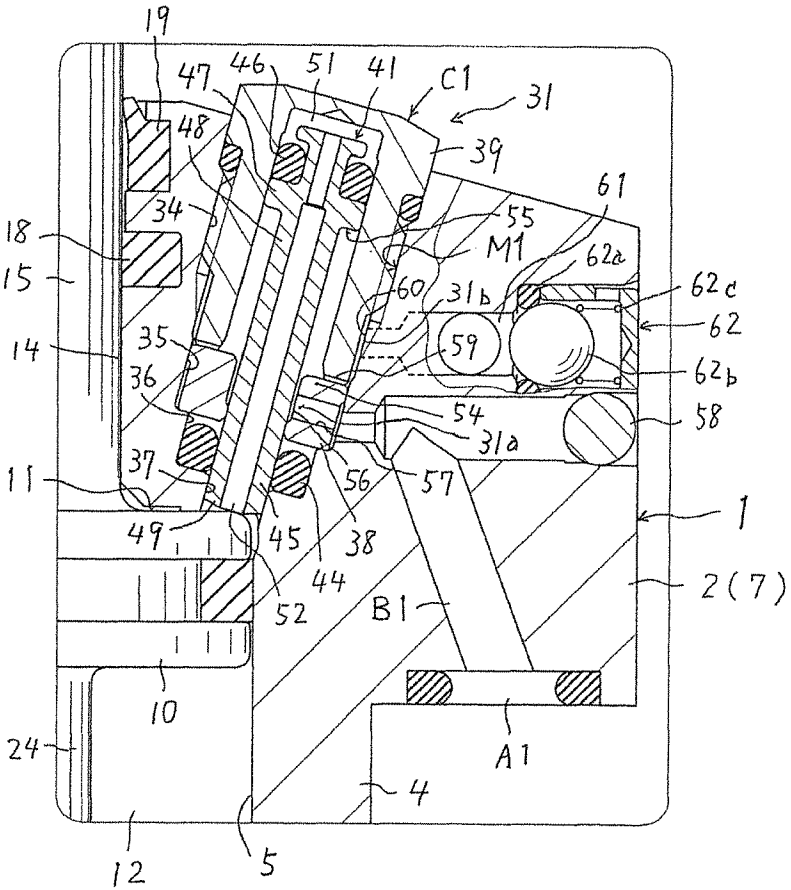
FIG. 4A is a partial enlarged view of FIG. 1A, illustrating a descent-detecting first detection valve in the unclamping state.

To change from the above unclamping state to the clamping state shown in FIG. 3A and FIG. 3B, under the unclamping state shown in FIG. 1A and FIG. 1B, pressurized oil in the lower second driving chamber 12 is discharged through the second supply and discharge port P2, while pressurized oil at the first supply and discharge port P1 is supplied to the upper first driving chamber 11, to lower the piston 10. As a result, first, the lower rod 24 (with the piston 10, the output rod 15, and the clamp arm 16) descends while rotating along the rotational grooves 26*b*, and subsequently, the lower rod 24 descends straight down along the advance grooves 26*a*. With this, as shown in FIG. 3A, the clamp arm 16 presses a workpiece onto an upper surface of the stationary stand (the workpiece and the stationary stand are not illustrated).

During the descent of the piston 10, the descent-detecting first detection valve 31 and the ascent-detecting second detection valve 32 operate as follows.

As pressurized oil supplied to the first driving chamber 11 lowers the piston 10 from the upper limit position in FIG. 5A, the pressurized oil in the first driving chamber 11 is supplied to the pressure chamber 81 through the through hole 82 of the second detection rod 42, and the pressurized oil in the pressure chamber 81 lowers the second detection rod 42 from its upper limit position in FIG. 5A.

Subsequently, when the piston 10 descends the second stroke S2 as shown in an alternate long and two short dashes line figure in FIG. 5B, the annular outlet groove 86 of the connecting rod 78 faces the valve hole 84, and thereby the second detection valve 32 is fully opened. Therefore, pressurized air supplied to the second supply port A2 flows, through the second supply passage B2, the valve hole 84, the outlet groove 86, the two radial grooves 87 and 89, the annular passage 90, and the outlet hole 91, to the discharge passage 61 (see FIG. 4A). The pressurized air in the discharge passage 61 pushes the ball 62*b* of the check valve 62 to open the valve 62, to be discharged to the outside air (see FIG. 4A).

Thereafter, the piston 10 descends to the lower limit position shown in a solid line figure in FIG. 5B (and FIG. 3B).

Further, during the descent of the piston 10, pressurized oil supplied from the first driving chamber 11 to the pressure chamber 51 lowers the first detection rod 41 from its upper limit position in FIG. 4A. Subsequently, when the piston 10 descends the first stroke S1 as shown in an alternate long and two short dashes line figure in FIG. 4B, the valve surface 55 of the upper pressure receiving portion 47 comes into contact with the valve seat 54, to fully close the first detection valve 31. Therefore, pressure of the pressurized air at the first supply port Al increases to a setting value, and this increase in pressure is detected by a sensor, which shows that the clamp is in the clamping state.

Thereafter, the piston 10 descends to the lower limit position shown in a solid line figure in FIG. 4B (and FIG. 3A).

It should be noted that, in the above clamping state, the length of a part of the second detection rod 42 projecting into the first driving chamber 11 in FIG. 5B is shorter than the length of a part of the first detection rod 41 projecting into the first driving chamber 11 in FIG. 4B.

To change from the above clamping state to the unclamping state shown in FIG. 1A and FIG. 1B, under the clamping state shown in FIG. 3A and FIG. 3B, pressurized oil in the upper first driving chamber 11 is discharged while pressurized oil is supplied to the lower second driving chamber 12, to raise the piston 10. Then, the lower rod 24 (with the piston 10, the output rod 15, and the clamp arm 16) first ascends straight up along the advance grooves 26*a*, and subsequently, the lower rod 24 ascends while rotating along the rotational grooves 26*b*. With this, as shown in FIG. 1A, the clamp arm 16 is moved to a retreating position.

During the ascent of the piston 10, the descent-detecting first detection valve 31 and the ascent-detecting second detection valve 32 operate as follows.

As pressurized oil supplied to the second driving chamber 12 raises the piston 10 from the lower limit position in FIG. 4B, first, the piston 10 comes into contact with the operated portion 49 of the first detection valve 31 as shown in the alternate long and two short dashes line figure in FIG. 4B, and subsequently, the piston 10 pushes up the first detection rod 41, to separate the valve surface 55 from the valve seat 54. As a result, the first detection valve 31 is fully opened, and pressurized air at the first supply port A1 is discharged to the outside air, so that the pressure at the first supply port A1 decreases. Thereafter, as shown in FIG. 4A, the piston 10 ascends to the upper limit position, and pushes up the first detection rod 41 to its upper limit position.

Further, during the ascent of the piston 10, the piston 10 comes into contact with the operated portion 79 of the second detection valve 32 as shown in the alternate long and two short dashes line figure in FIG. 5B. Subsequently, as shown in FIG. 5A, when the piston 10 ascends to the upper limit position, the piston 10 pushes up the second detection rod 42 to its upper limit position, so that the valve surface 85 of the second detection rod 42 faces the valve hole 84. With this, the second detection valve 32 is fully closed. Therefore, pressure of the pressurized air at the second supply port A2 increases to the setting value, and this increase in pressure is detected by the sensor, which shows that the clamp is in the clamping state.

The above-described embodiment can be modified as follows.

The descent-detecting first detection valve 31 may be structured differently as long as: the first detection valve 31 is opened by the piston 10 in the course of movement of the piston 10 from the lower limit position to the upper limit position; and the first detection valve 31 is closed when the piston 10 descends the predetermined first stroke S1 from the upper limit position. Therefore, various cases are possible such as a case where the first detection valve 31 is fully closed when the piston 10 descends from the upper limit position to a clamp stroke area (an area corresponding to the stroke area of the advance grooves 26*a*), and a case where the first detection valve 31 is fully closed when the piston 10 descends from the upper limit position to a position in the vicinity of the clamp stroke area.

Meanwhile, the ascent-detecting second detection valve 32 may be structured differently as long as: the second detection valve 32 is closed by the piston 10 when the piston 10 moves from the lower limit position to the upper limit position or to the position in the vicinity of the upper limit position; and the second detection valve 32 is opened when the piston 10 descends the predetermined second stroke S2 from the upper limit position. Therefore, instead of being fully closed at the upper limit position, the second detection valve 32 may be fully closed when the piston 10 ascends to a position in the vicinity of the upper limit position.

Each of the first detection valve 31 and the second detection valve 32 may be arranged to be parallel to the axis of the piston 10 instead of being arranged obliquely to the axis of the piston 10.

Further, the above-described two detection valves 31 and 32 are arranged in the right wall portion, in plan view, out of the four wall portions corresponding to the four sides of the upper wall 2 of the housing 1; however, instead of this, the detection valves 31 and 32 may be provided in an upper or lower wall portion in plan view. The upper wall 2 may be formed into a substantially square shape, in plan view, instead of being formed into the substantially rectangular shape.

The valve structure of each of the detection valves 31 and 32 may be freely chosen between the poppet type and the spool type.

The output rod 15 may be structured differently as long as the output rod 15 is connected to the piston 10 so as to be driven in company with the piston 10. The output rod 15 may be formed separately from the piston 10 instead of being formed integrally with the piston 10.

The cylinder apparatus may be structured as an apparatus of a single-acting spring return type or a spring-locking and hydraulic-releasing type, instead of the double-acting type, which is exemplarily described. Pressurized fluid for driving used in the cylinder apparatus may be gas such as compressed air, instead of the exemplarily described pressurized oil.

Further, the cylinder apparatus of the present invention is applicable to a technical field different from that of the clamps.

Furthermore, it is a matter of course that other changes or alterations can be made on the present invention within the scope of envisagement of one skilled in the art.

The invention claimed is:

1. A cylinder apparatus comprising:

a piston (10) inserted into a housing (1) ascendably and descendably;

a driving chamber (11) which is arranged above the piston (10) and where pressurized fluid for driving is supplied and discharged;

an output rod (15) which is connected to the piston (10) and inserted into an upper wall (2) of the housing (1);

a descent-detecting first detection valve (31) and an ascent-detecting second detection valve (32) which are arranged outside a periphery of the output rod (15) and in the upper wall (2), to be circumferentially spaced apart from each other at a predetermined interval, each of the first detection valve (31) and the second detection valve (32) having an operated portion (49) (79) which faces the piston (10) from above; and a first supply passage (B1) and a second supply passage (B2) through which pressurized air for detection is supplied to respective inlets (31*a*) (32*a*) of the first detection valve (31) and the second detection valve (32), respectively.

2. The cylinder apparatus according to claim 1, wherein an axis of each of the first detection valve (31) and the second detection valve (32) is inclined to become closer to an axis of the piston (10) downwardly, and an angle of inclination is set to fall within a range from 5 degrees to 15 degrees.

3. The cylinder apparatus according to claim 2, wherein:

the descent-detecting first detection valve (31) is configured to be opened by the piston (10) in the course of movement of the piston (10) from a lower limit position to an upper limit position, and to be closed when the piston (10) descends a predetermined first stroke (S1) from the upper limit position; and the ascent-detecting second detection valve (32) is configured to be closed by the piston (10) when the piston (10) moves from the lower limit position to the upper limit position or to a position in the vicinity of the upper limit position, and to be opened when the piston (10) descends a predetermined second stroke (S2) from the upper limit position, and a length of the second stroke (S2) is set to be smaller than a length of the first stroke (S1).

4. The cylinder apparatus according to claim 3, wherein the descent-detecting first detection valve (31) includes: a first installation hole (M1) formed in the upper wall (2) so as to face the driving chamber (11) from above; a first casing (C1) mounted in the first installation hole (M1); a first detection rod (41) inserted into the first casing (C1), the first detection rod (41) having a lower pressure receiving portion (45), an upper pressure receiving portion (47) of which pressure receiving area is larger than that of the lower pressure receiving portion (45), and the operated portion (49); a pressure chamber (51) formed above the upper pressure receiving portion (47); a through hole (52) formed through the first detection rod (41) so as to communicatively connect the pressure chamber (51) to the driving chamber (11); a poppet valve surface (55) formed on a lower portion of the upper pressure receiving portion (47); and a valve seat (54) formed on the first casing (C1), the valve seat (54) configured to be closed by the valve surface (55) when the first detection rod (41) descends.

5. The cylinder apparatus according to claim 3, wherein the ascent-detecting second detection valve (32) includes: a second installation hole (M2) formed in the upper wall (2) so as to face the driving chamber (11) from above; a second casing (C2) mounted in the second installation hole (M2); a second detection rod (42) inserted into the second casing (C2), the second detection rod (42) having a lower pressure receiving portion (75), an upper pressure receiving portion (77) of which pressure receiving area is larger than that of the lower pressure receiving portion (75), and the operated portion (79); a pressure chamber (81) formed above the upper pressure receiving portion (77); a through hole (82) formed through the second detection rod (42) so as to communicatively connect the pressure chamber (81) to the driving chamber (11); a spool valve surface (85) formed on an outer peripheral surface of the second detection rod (42); and a valve hole (84) formed in the second casing (C2), the valve hole (84) configured to be closed by the valve surface (85) when the second detection rod (42) ascends.

6. The cylinder apparatus according to claim 1, wherein:

the upper wall (2) is formed into a substantially rectangular or square shape in plan view, and a supply and discharge passage (21) which is communicatively connected to the driving chamber (11) is formed in one wall portion out of four wall portions respectively corresponding to four peripheral sides of the upper wall (2); and the first detection valve (31) and the second detection valve (32) are provided in any other wall portion than the wall portion where the supply and discharge passage (21) is formed out of the four wall portions.

7. The cylinder apparatus according to claim 6, wherein the upper wall (2) has a flange (7) for mounting, and a supply and discharge port (P1) communicatively connected to the supply and discharge passage (21) is opened onto a mounting surface (7*a*) formed on an under surface of an outer periphery portion of the flange (7).

8. The cylinder apparatus according to claim 7, wherein:

the descent-detecting first detection valve (31) is configured to be opened by the piston (10) in the course of movement of the piston (10) from a lower limit position to an upper limit position, and to be closed when the piston (10) descends a predetermined first stroke (S1) from the upper limit position; and the ascent-detecting second detection valve (32) is configured to be closed by the piston (10) when the piston (10) moves from the lower limit position to the upper limit position or to a position in the vicinity of the upper limit position, and to be opened when the piston (10) descends a predetermined second stroke (S2) from the upper limit position, and a length of the second stroke (S2) is set to be smaller than a length of the first stroke (S1).

9. The cylinder apparatus according to claim 8, wherein the descent-detecting first detection valve (31) includes: a first installation hole (M1) formed in the upper wall (2) so as to face the driving chamber (11) from above; a first casing (C1) mounted in the first installation hole (M1); a first detection rod (41) inserted into the first casing (C1), the first detection rod (41) having a lower pressure receiving portion (45), an upper pressure receiving portion (47) of which pressure receiving area is larger than that of the lower pressure receiving portion (45), and the operated portion (49); a pressure chamber (51) formed above the upper pressure receiving portion (47); a through hole (52) formed through the first detection rod (41) so as to communicatively connect the pressure chamber (51) to the driving chamber (11); a poppet valve surface (55) formed on a lower portion of the upper pressure receiving portion (47); and a valve seat (54) formed on the first casing (C1), the valve seat (54) configured to be closed by the valve surface (55) when the first detection rod (41) descends.

10. The cylinder apparatus according to claim 8, wherein the ascent-detecting second detection valve (32) includes: a second installation hole (M2) formed in the upper wall (2) so as to face the driving chamber (11) from above; a second casing (C2) mounted in the second installation hole (M2); a second detection rod (42) inserted into the second casing (C2), the second detection rod (42) having a lower pressure receiving portion (75), an upper pressure receiving portion (77) of which pressure receiving area is larger than that of the lower pressure receiving portion (75), and the operated portion (79); a pressure chamber (81) formed above the upper pressure receiving portion (77); a through hole (82) formed through the second detection rod (42) so as to communicatively connect the pressure chamber (81) to the driving chamber (11); a spool valve surface (85) formed on an outer peripheral surface of the second detection rod (42); and a valve hole (84) formed in the second casing (C2), the valve hole (84) configured to be closed by the valve surface (85) when the second detection rod (42) ascends.

11. The cylinder apparatus according to claim 6, wherein: the descent-detecting first detection valve (31) is configured to be opened by the piston (10) in the course of movement of the piston (10) from a lower limit position to an upper limit position, and to be closed when the piston (10) descends a predetermined first stroke (S1) from the upper limit position; and the ascent-detecting second detection valve (32) is configured to be closed by the piston (10) when the piston (10) moves from the lower limit position to the upper limit position or to a position in the vicinity of the upper limit position, and to be opened when the piston (10) descends a predetermined second stroke (S2) from the upper limit position, and a length of the second stroke (S2) is set to be smaller than a length of the first stroke (S1).

12. The cylinder apparatus according to claim 11, wherein the descent-detecting first detection valve (31) includes: a first installation hole (M1) formed in the upper wall (2) so as to face the driving chamber (11) from above; a first casing (C1) mounted in the first installation hole (M1); a first detection rod (41) inserted into the first casing (C1), the first detection rod (41) having a lower pressure receiving portion (45), an upper pressure receiving portion (47) of which pressure receiving area is larger than that of the lower pressure receiving portion (45), and the operated portion (49); a pressure chamber (51) formed above the upper pressure receiving portion (47); a through hole (52) formed through the first detection rod (41) so as to communicatively connect the pressure chamber (51) to the driving chamber (11); a poppet valve surface (55) formed on a lower portion of the upper pressure receiving portion (47); and a valve seat (54) formed on the first casing (C1), the valve seat (54) configured to be closed by the valve surface (55) when the first detection rod (41) descends.

13. The cylinder apparatus according to claim 11, wherein the ascent-detecting second detection valve (32) includes: a second installation hole (M2) formed in the upper wall (2) so as to face the driving chamber (11) from above; a second casing (C2) mounted in the second installation hole (M2); a second detection rod (42) inserted into the second casing (C2), the second detection rod (42) having a lower pressure receiving portion (75), an upper pressure receiving portion (77) of which pressure receiving area is larger than that of the lower pressure receiving portion (75), and the operated portion (79); a pressure chamber (81) formed above the upper pressure receiving portion (77); a through hole (82) formed through the second detection rod (42) so as to communicatively connect the pressure chamber (81) to the driving chamber (11); a spool valve surface (85) formed on an outer peripheral surface of the second detection rod (42); and a valve hole (84) formed in the second casing (C2), the valve hole (84) configured to be closed by the valve surface (85) when the second detection rod (42) ascends.

14. The cylinder apparatus according to claim 1, wherein: the descent-detecting first detection valve (31) is configured to be opened by the piston (10) in the course of movement of the piston (10) from a lower limit position to an upper limit position, and to be closed when the piston (10) descends a predetermined first stroke (S1) from the upper limit position; and the ascent-detecting second detection valve (32) is configured to be closed by the piston (10) when the piston (10) moves from the lower limit position to the upper limit position or to a position in the vicinity of the upper limit position, and to be opened when the piston (10) descends a predetermined second stroke (S2) from the upper limit position, and a length of the second stroke (S2) is set to be smaller than a length of the first stroke (S1).

15. The cylinder apparatus according to claim 14, wherein the descent-detecting first detection valve (31) includes: a first installation hole (M1) formed in the upper wall (2) so as to face the driving chamber (11) from above; a first casing (C1) mounted in the first installation hole (M1); a first detection rod (41) inserted into the first casing (C1), the first detection rod (41) having a lower pressure receiving portion (45), an upper pressure receiving portion (47) of which pressure receiving area is larger than that of the lower pressure receiving portion (45), and the operated portion (49); a pressure chamber (51) formed above the upper pressure receiving portion (47); a through hole (52) formed through the first detection rod (41) so as to communicatively connect the pressure chamber (51) to the driving chamber (11); a poppet valve surface (55) formed on a lower portion of the upper pressure receiving portion (47); and a valve seat (54) formed on the first casing (C1), the valve seat (54) configured to be closed by the valve surface (55) when the first detection rod (41) descends.

16. The cylinder apparatus according to claim 14, wherein the ascent-detecting second detection valve (32) includes: a second installation hole (M2) formed in the upper wall (2) so as to face the driving chamber (11) from above; a second casing (C2) mounted in the second installation hole (M2); a second detection rod (42) inserted into the second casing (C2), the second detection rod (42) having a lower pressure receiving portion (75), an upper pressure receiving portion (77) of which pressure receiving area is larger than that of the lower pressure receiving portion (75), and the operated portion (79); a pressure chamber (81) formed above the upper pressure receiving portion (77); a through hole (82) formed through the second detection rod (42) so as to communicatively connect the pressure chamber (81) to the driving chamber (11); a spool valve surface (85) formed on an outer peripheral surface of the second detection rod (42); and a valve hole (84) formed in the second casing (C2), the valve hole (84) configured to be closed by the valve surface (85) when the second detection rod (42) ascends.

* * * * *